US007013281B2

(12) United States Patent
Henrie et al.

(10) Patent No.: US 7,013,281 B2
(45) Date of Patent: Mar. 14, 2006

(54) SOUND GENERATOR CIRCUIT PRE-FILTER SYSTEM AND METHOD

(75) Inventors: James B. Henrie, Grays Lake, IL (US); Wayne B. Hile, Round Lake Park, IL (US)

(73) Assignee: Palm, Inc., Santa Clara, CA (US)

( * ) Notice: Subject to any disclaimer, the term of this patent is extended or adjusted under 35 U.S.C. 154(b) by 732 days.

(21) Appl. No.: 09/804,345

(22) Filed: Mar. 12, 2001

(65) Prior Publication Data

US 2002/0173963 A1 Nov. 21, 2002

(51) Int. Cl.
*G10L 21/00* (2006.01)

(52) U.S. Cl. ..... 704/270.1; 704/275; 340/384.71; 381/57

(58) Field of Classification Search ..... 204/270.1, 204/275; 381/384.1, 384.73, 57
See application file for complete search history.

(56) References Cited

U.S. PATENT DOCUMENTS 4,118,601 A * 10/1978 Yeap ..... 381/103
4,283,600 A * 8/1981 Cohen ..... 381/61
4,314,236 A * 2/1982 Mayer et al. ..... 340/384.71
4,618,985 A * 10/1986 Pfeiffer ..... 704/261
5,095,798 A * 3/1992 Okada et al. ..... 463/35
5,459,790 A * 10/1995 Scofield et al. ..... 381/310
5,635,903 A * 6/1997 Koike et al. ..... 340/441
5,781,636 A * 7/1998 Tai ..... 381/62
5,872,852 A * 2/1999 Dougherty ..... 381/57
5,890,115 A * 3/1999 Cole ..... 704/258
5,974,101 A * 10/1999 Nago ..... 375/350
6,011,473 A * 1/2000 Klein ..... 340/571
6,202,109 B1 * 3/2001 Salo et al. ..... 710/301
6,311,982 B1 * 11/2001 Lebensfeld et al. ..... 273/460
6,532,005 B1 * 3/2003 Campbell ..... 345/173
6,725,109 B1 * 4/2004 Hile et al. ..... 700/94
6,778,672 B1 * 8/2004 Breed et al. ..... 381/86
6,801,629 B1 * 10/2004 Brimhall et al. ..... 381/72

OTHER PUBLICATIONS

DragonBall™ MC68EZ328 Application Notes, © 1996 Motorola, Inc., 7 pps.
DragonBall™ MC68EZ328 Application Notes, © 1996 Motorola, Inc., 7 pps. no month/day.

* cited by examiner

*Primary Examiner*—Susan McFadden
(74) *Attorney, Agent, or Firm*—Foley & Lardner LLP

(57) ABSTRACT

A sound generator apparatus configured to improve sound quality for a sound generator that includes a processing device and a memory coupled to the processing device. The sound generator apparatus also includes a sound generator coupled to the processing device. Further, the sound generator apparatus includes a program residing in memory and configured to be run on the processing device that is configured to vary the output amplitude of the sound generator depending on the sound generator frequency. A method of improving sound quality for a sound generator that includes providing a signal indicative of a sound frequency to be generated. The method includes calculating volume adjustment information according to the sound frequency to be generated. Further, the method includes providing the current volume setting and adjusting the volume based on the volume adjustment information.

20 Claims, 4 Drawing Sheets

SOUND GENERATOR CIRCUIT PRE-FILTER SYSTEM AND METHOD

FIELD OF THE INVENTION

The invention relates to sound generators typically used in computing devices. In particular, the invention relates to a software pre-filter for a sound generating circuit, the pre-filter being a software pre-filter. Further, the invention relates to a compact sound generator circuit using a software pre-filter for a personal digital assistant. Yet further still, the invention relates to a method of improving the sound quality of a simple sound generator.

BACKGROUND OF THE INVENTION

Hand held computing devices, "palmtops", or "palmhelds", personal digital assistants (PDAs), or hand held computers typically weight less than a pound and fit in a pocket. These palmhelds generally provide some combination of personal information management, database functions, word processing, and spreadsheets. Because of the small size and portability of palmhelds, strict adherence to hardware constraints, such as sound generation hardware, must be maintained. It is conventional to use a sound generator in a palmheld device which is configured to operate ideally at a particular single frequency, rather than across a broad audio frequency range. When the sound generator is used across the audio frequency range, it provides "poor sound quality" with a widely varying sound pressure level over the audio frequency range for the same user setting.

Other conventional implementations of sound generation circuits include a dynamic speaker that is designed to operate across an audio frequency range having a substantially flat frequency response across the range. Such dynamic speakers are physically larger and cost many times more than sound generators. Further, the dynamic speaker drive circuit is also more complicated and expensive to implement than simple sound generators.

Accordingly, there is a need for a compact sound generator circuit that utilizes a software pre-filter to improve sound quality over an audible frequency range. Further, there is a need for a method of pre-filtering sound generator circuit signals in order to provide improved sound quality using a compact sound generator circuit.

The teachings herein below extend to those embodiments which fall within the scope of the appended claims, regardless of whether they accomplish one or more of the above mentioned needs.

SUMMARY OF THE INVENTION

An exemplary embodiment relates to an apparatus configured to improve sound quality for a sound generator. The apparatus includes a processing device and a memory coupled to the processing device. The apparatus also includes a sound generator coupled to the processing device. The apparatus also includes a program residing in memory and configured to be run on the processing device. The program is configured to vary the output amplitude of the sound generator depending on the sound generator frequency.

Another exemplary embodiment relates to a sound generator circuit. The sound generator circuit includes a processor and a memory coupled to the processor. The sound generator circuit also includes a modulator circuit coupled to the processor. The sound generator circuit further includes a transistor coupled to the modulator circuit. Further still, the sound generator circuit includes a sound generator coupled to the transistor. Yet further still, the sound generator circuit includes a program residing in memory and configured to be run on the processor. The program is configured to vary the output amplitude of the sound generator depending on the sound generator frequency.

Further, an exemplary embodiment relates to a method of improving sound quality for a sound generator. The method includes providing a signal indicative of a sound frequency to be generated. The method also includes accessing a lookup table according to the sound frequency to be generated to obtain volume adjusted information. The method further includes providing the current volume setting and adjusting the volume based on the volume adjustment information.

Further still, an exemplary embodiment relates to a method of improving sound quality for a sound generator. The method includes providing a signal indicative of a sound frequency to be generated. The method also includes calculating volume adjustment information according to the sound frequency to be generated. Further, the method includes providing the current volume setting. Further still, the method includes adjusting the volume based on the volume adjustment information.

BRIEF DESCRIPTION OF THE DRAWINGS

The invention will become more fully understood from the following detailed description, taken in conjunction with the accompanying drawings, wherein like reference numerals refer to like elements, in which.

DETAILED DESCRIPTION OF THE PREFERRED EMBODIMENTS

Figure 1:
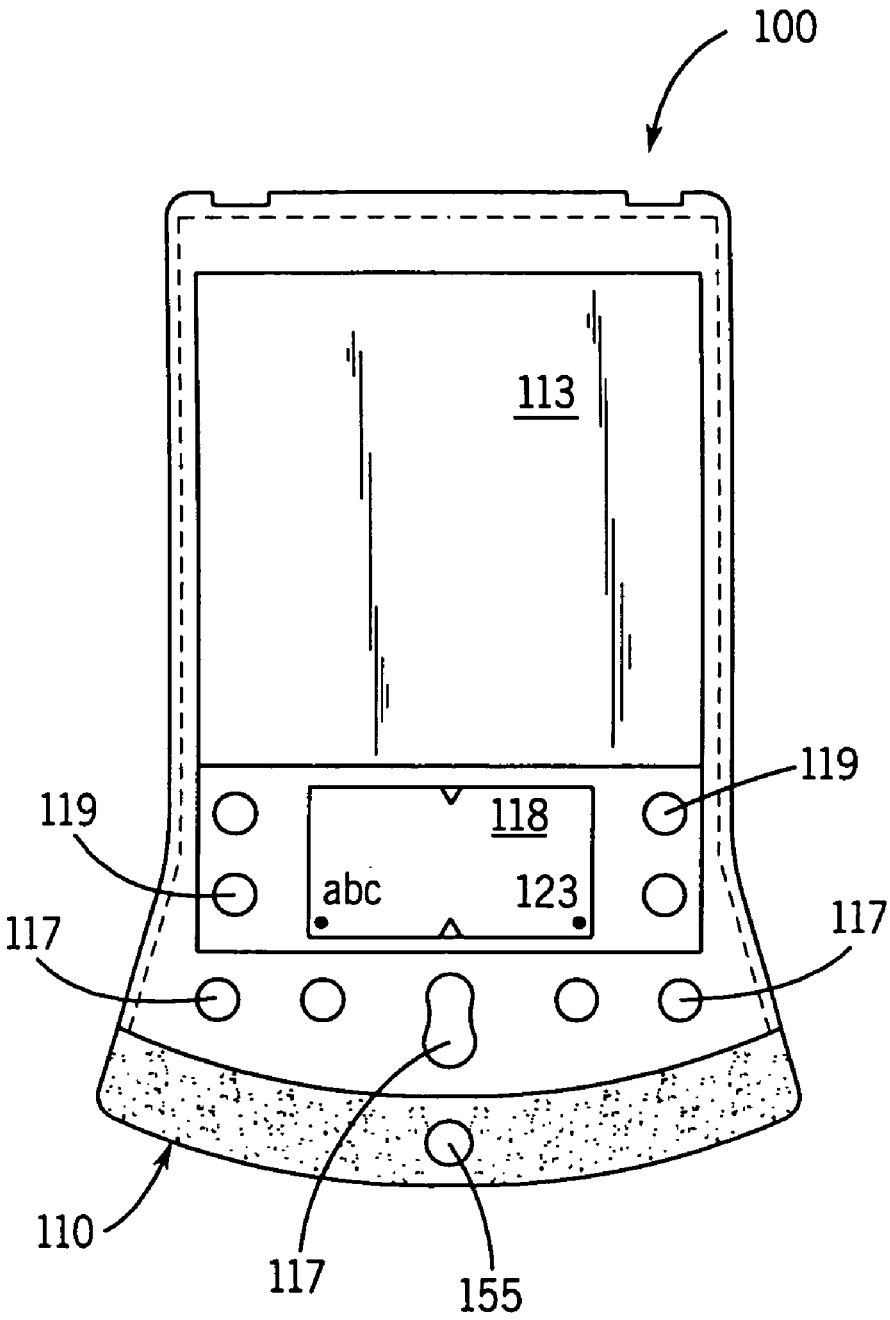
FIG. 1 is a depiction of a hand held computer.

Referring to FIG. 1, a hand held computer 100 is depicted, being optionally detachably coupled to an accessory device 110 according to an exemplary embodiment. Hand held computer 100 may include Palm style computers such as, but not limited to, Palm Pilot™, Palm III™, Palm IIIc™, Palm V™, Palm VII™, and Palm M100™ organizers, manufactured by Palm, Inc., of Santa Clara, Calif. Other exemplary embodiments of the invention may include Windows CE™ hand held computers, or other hand held computers and personal digital assistants, as well as cellular telephones, and other mobile computing devices. Further, hand held computer 100 may be configured with or without accessory device 110 or optionally with any of a variety of other accessory devices.

Preferably, hand held computer 100 includes interactive hardware and software that performs functions such as maintaining calendars, phone lists, task lists, notepads, calculation applications, spreadsheets, games, and other applications capable of running on a computing device. Hand held computer 100, shown in FIG. 1 includes a plurality of input functions, keys 117 and a display 113 having graphical user interface features. Display 113 may be provided with an interface that allows a user to select and alter displayed content using a pointer, such as, but not limited to, a stylus. In an exemplary embodiment, display 113 also includes a Graffiti™ writing section 118, or other handwriting recognition software, for tracing alphanumeric characters as input. A plurality of input buttons 119 for performing automated or preprogrammed functions may be provided on a portion of display 113. In a particular embodiment, display 113 is a touch screen display that is electronically responsive to movements of a stylus on the surface of display 113.

Accessory device 110 may be one of several types of accessories, such as, but not limited to, a modem device for serial and/or wireless data communications, a Universal Serial Bus (USB) device, or a communication cradle having an extended housing. Accessory device 110 may include one or more ports for parallel and/or serial data transfer with other computers or data networks. Hand held computer 100 may use the accessory device 110 for the purpose of downloading and uploading software and for synchronizing data on hand held computer 100 with a personal computer, for example. Accessory device 110 couples to hand held computer 100 through an electrical connector located at a bottom portion of its front face. Button 155 on accessory 110 may effectuate an electrical connection between accessory device 110 and hand held computer 100 when the two are connected.

Figure 2:
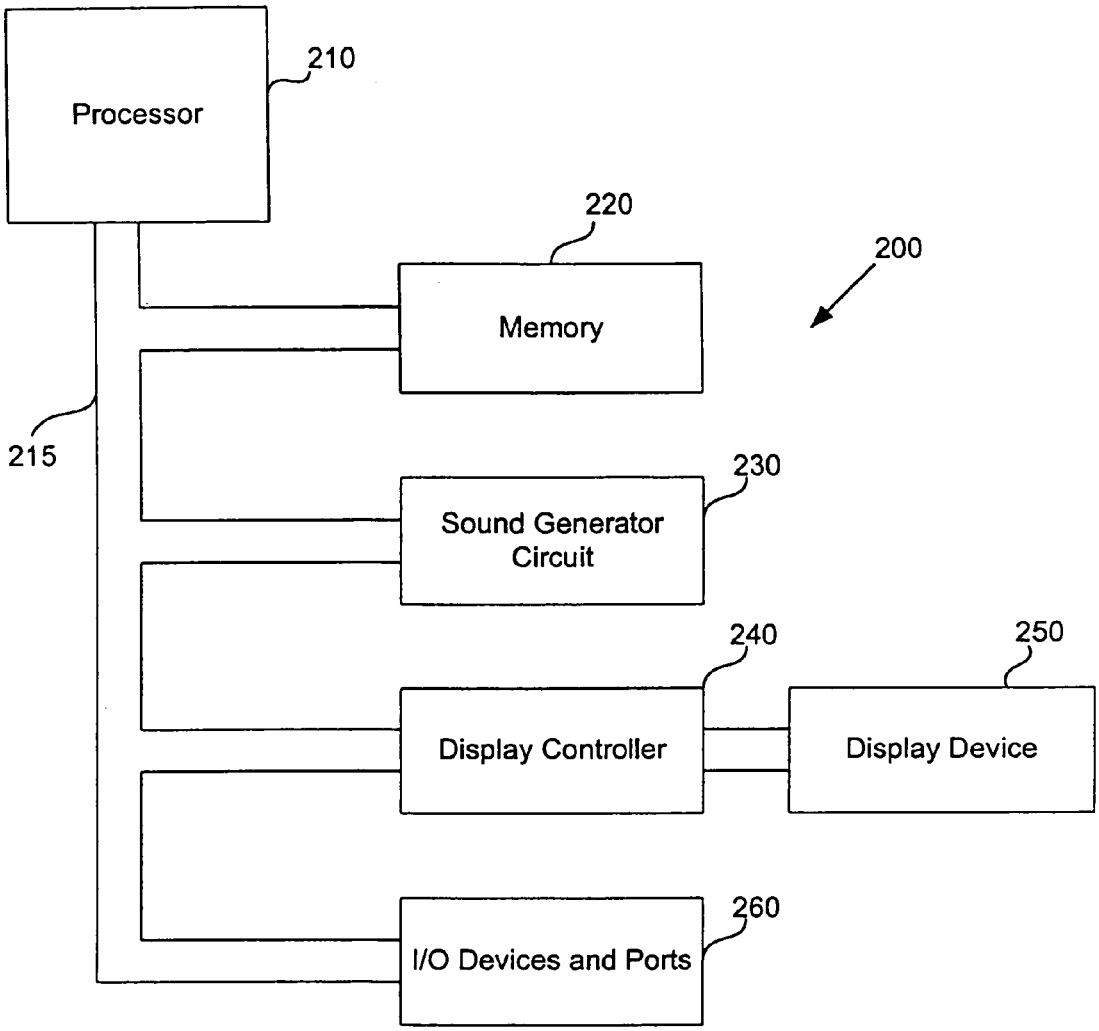
FIG. 2 is an exemplary block diagram of a communications bus architecture for a hand held computer.

Referring to FIG. 2, an exemplary block diagram of a communications bus architecture 200 for a hand held computer, such as hand held computer 100, is depicted. Communications bus architecture 200 includes a processor 210 coupled to a communications bus 215. A memory 220, a sound generator circuit 230, a display controller 240, and various input/output (I/O) devices and ports 260 are all coupled to communications bus 215. Further, a display device 250 is coupled to display controller 240 which is coupled to communications bus 215. Processor 210 is configured to run programs stored in memory 220 and to selectively provide sound, as required through a sound generator circuit 230. Further, display device 250 is configured to display information as necessary according to the program running on processor 210 and instructions from display controller 240. Input/output devices and ports 260 are used to provide communication and access to any of a number of and/or a variety of input/output devices, such as, but not limited to, printers, network connections, storage devices, other hand held computers, wireless devices, cellular devices, modems, and the like. Sound generator circuit 230 may be any of a variety of sound generators generating circuits including, but not limited to buzzers, and other sound generating devices such as speaker-based devices and the like.

Figure 3:
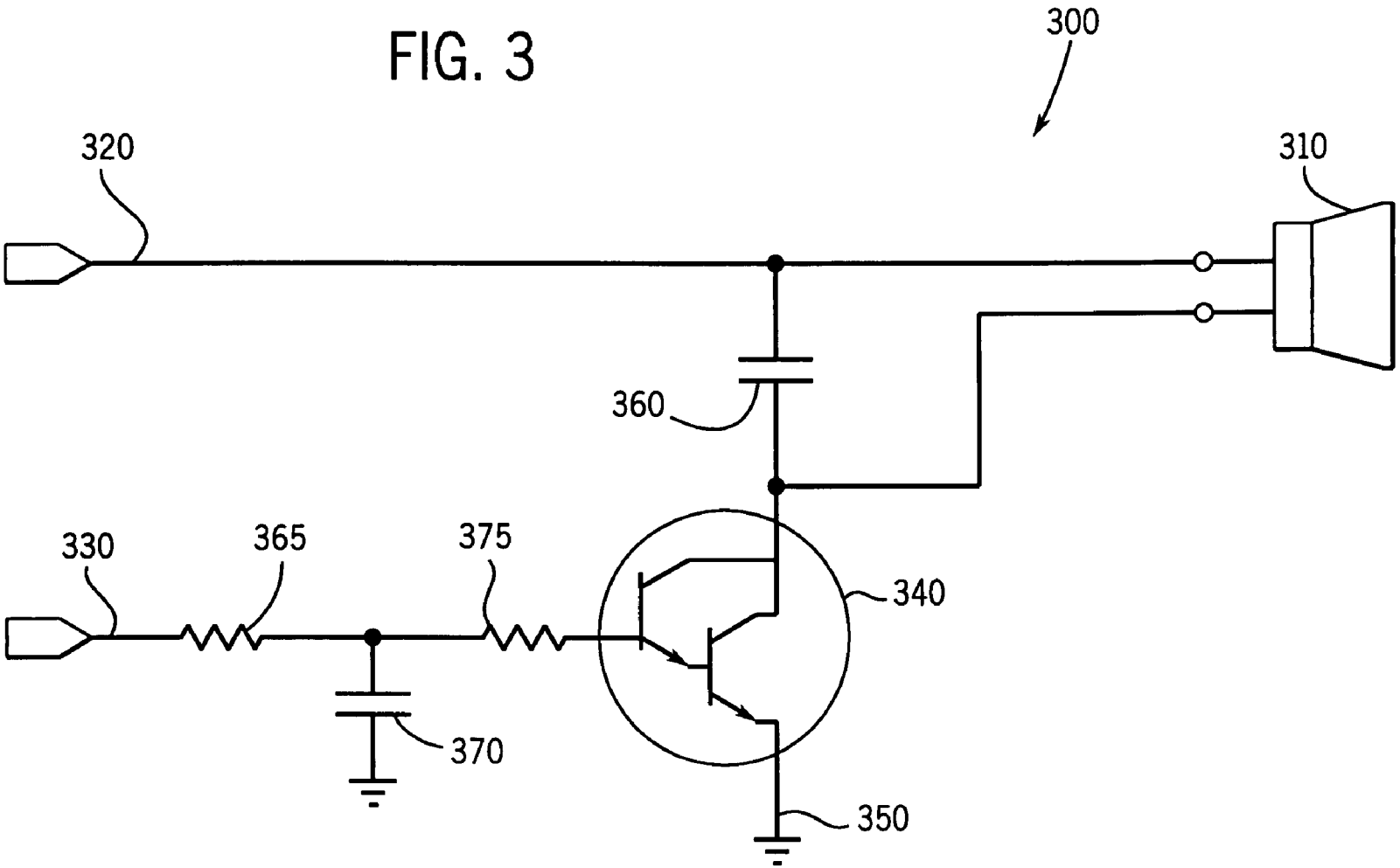
FIG. 3 is an exemplary partial circuit diagram of a sound generator circuit.

Referring now to FIG. 3, an exemplary sound generator circuit 300 is depicted. Sound generator circuit 300 includes a buzzer 310, such as, but not limited to a Bujeon BCT-03SR buzzer available from Bujeon Components Company, Limited of Ansan City, Gyunggi-do, Korea, a Citisound CHB-03F available from Citizen Electronics Company, Limited of Kamikurechi Fujiyoshida-shi Yamanashi-ken, Japan, or any of a variety of other buzzer or sound generation devices. Sound generation circuit 300 includes a battery high input 320 for providing a voltage input to buzzer 310 and a pulse width modulated current (PWM) input 330 receiving a modulated input from a PWM as controlled by a processor, such as, but not limited to a DragonBall™ processor, available from Motorola, Inc. of Austin, Tex. or any of a variety of other processor or processing devices (in an exemplary embodiment the PWM may be incorporated into the processor). Circuit 300 also includes a transistor, shown as darlington transistor 340 providing switching to buzzer 310 according to the PWM signal received. Transistor 340 is configured to alternately drive the current through buzzer 310 or to short buzzer 310 to ground 350. Circuit 300 also includes a capacitor 360 for filtering out high frequency signals and a resistor 365 and capacitor 370 combination also for filtering out high frequency signals. Further still, circuit 300 includes a current limiting resistor 375 configured to limit high current signals received from the PWM. Circuit 300 is exemplary of any of a variety of sound generation circuits and is not included to limit the scope of the claims but has been included to show one possible implementation thereof.

Figure 4:
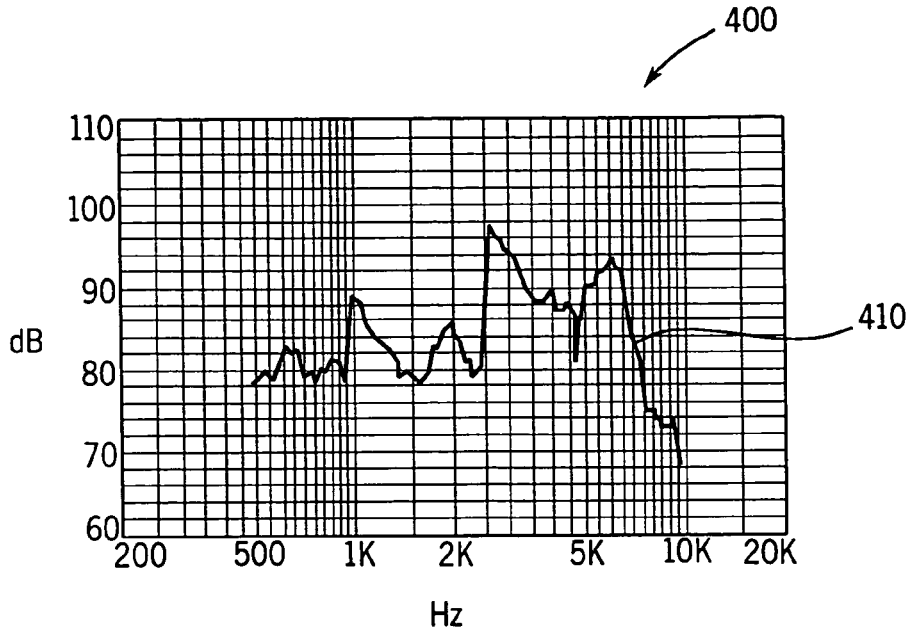
FIG. 4 is a graphical depiction of the frequency response of an exemplary sound generator.

Referring now to FIG. 4, an exemplary frequency response graph is depicted for a sound generator, such as buzzer 310. In particular, graph 400 is the frequency response for a CHB-03F Citisound sound generator. Line 410 depicts the amplitude (sound pressure level) of the tone generated on the Y axis at the frequency provided along the X axis. Inspection of graph 400 reveals that the sound amplitude generated varies widely over the frequency response range. A maximum sound pressure level (or amplitude) occurs at approximately 2.7 kilohertz. In a particular embodiment, sound generator circuit 300 is utilized in a palmheld device or hand held computer in which an exemplary audible range is used from about 500 hertz to 7 kilohertz, however, other audible ranges or frequency ranges of interest may be used.

Without the improvement described herein, the volume for a hand held computer is set to a particular level by the user ranging, for example, from 1 to 7. Different tones are played in sequence by buzzer 310 at the fixed volume setting for different durations to create the hand held sounds or tunes. Because each tone has a different sound pressure level (or amplitude) with some widely varying, an inconsistent sound level is produced. For example, as depicted in graph 400, a 1.6 kilohertz tone has a sound pressure level of around 81 decibels while a 2.7 kilohertz tone has a sound pressure level of around 96 decibels. This variation of sound pressure level over frequency degrades the sound quality by misrepresenting the tone being played. The use of a software pre-filter may be configured to change the volume at particular frequencies to provide a flatter frequency response curve. An exemplary implementation of the software pre-filter uses a look-up table of frequencies versus adjustment amount of volume to reduce. An exemplary look-up table for a hand held computer using the CHB-03F Citisound sound generator is shown below.

| Frequency | Adjustment |
|---|---|
| 0 | 0 |
| 256 | 0 |
| 512 | 1 |
| 768 | 1 |
| 1024 | 2 |
| 1280 | 1 |
| 1536 | 1 |
| 1792 | 0 |
| 2048 | 0 |
| 2304 | 1 |
| 2560 | 2 |
| 2816 | 3 |
| 3072 | 3 |

-continued

| Frequency | Adjustment |
|---|---|
| 3328 | 2 |
| 3584 | 2 |
| 3840 | 1 |
| 4096 | 0 |
| 4352 | 0 |
| 4608 | 1 |
| 4864 | 2 |
| 5120 | 2 |
| 5376 | 3 |
| 5632 | 3 |
| 5888 | 3 |
| 6144 | 3 |
| 6400 | 2 |
| 6656 | 2 |
| 6912 | 1 |
| 7168 | 0 |
| 7424 | 0 |

In an exemplary embodiment, the table above is calibrated for a volume setting of 7. Because the volume can be changed by a user, the adjustment amount must also change by the same ratio. Accordingly, the equation to scale the adjustment amount over volume is provided in the program code below;

```
// Calculate the amplitude adjustment based on the amplitude and
frequency passed in.
// This attempts to level the frequency response.
// if ampAdjMapIndex is in the middle or greater then go to the
next ampAdjMapIndex.
ampAdjTableIndex = (Frq + 128) >> 8;
if (ampAdjTableIndex >= AmpAdjTableSize-1)
//limit index to end of table
  ampAdj = ampAdjTable[AmpAdjTableSize-1];
else
  ampAdj = (ampAdjTable[ampAdjTableIndex]*volume) / volumeMax;
        // scale adjust over volume.
//The adjustment value is subtracted from the volume for that particular
tone as shown
//below in equation 2.
//Equation 2
adjustedVolume = volume - ampAdj;
```

Once adjusted volume has been calculated in equation 2, the use of the adjustedVolume gives a flatter frequency response. In an exemplary embodiment the frequency response may not be completely flat due to quantization error in the table and because of the limited volume steps, for example, 1–7, that are being used. However, improvement over the use of an unfiltered sound generator is affected. It should be noted that the quantization of the table and the number of volume steps may differ depending on the hardware configurations and software configurations used and the flatness of the frequency response desired. Use of the software pre-filter described above provides an audible improvement in sound for alarms, games, etc. in hand held computing devices and other devices using sound generators, such as buzzers 310 while not requiring complex or costly hardware improvements.

Figure 5:
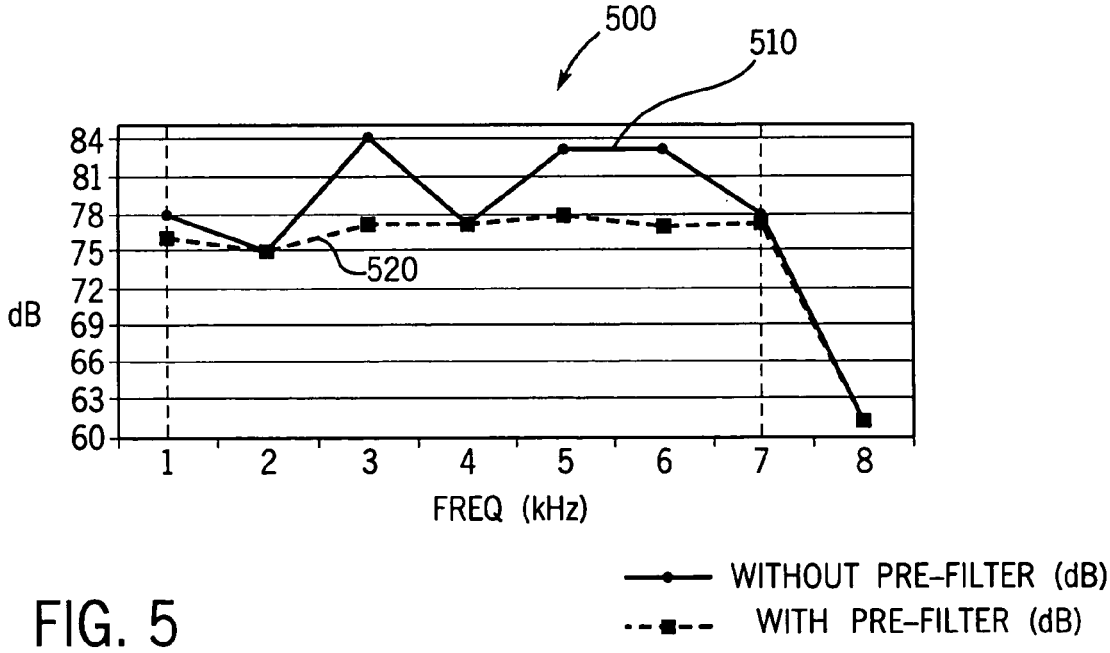
FIG. 5 is a graphical depiction of the frequency response of an exemplary sound generator using an exemplary pre-filter and without using a pre-filter.

Referring now to FIG. 5, an exemplary frequency response graph 500 is depicted. Frequency response graph 500 depicts the response of a buzzer, such as 310 without using a software pre-filter as described above. Frequency response 510 is seen as relatively choppy in comparison with frequency response 520, which is the frequency response of a buzzer utilizing a software pre-filter as discussed above. Frequency response 520 is relatively flat having a response generally in the range of 75 decibels to 78 decibels in the usable range which is from approximately 1 kilohertz to 7 kilohertz in this example. However, any of a variety of usable ranges may be designed, depending on the hardware and software constraints and configurations used. Frequency response 510, which does not use a pre-filter has a range of 75 to 84 decibels in the usable range of 1 kilohertz to 7 kilohertz, which is clearly a much larger range as compared with frequency response 520. Accordingly, the example depicted in FIG. 5 shows the clear advantage of utilizing a pre-filter as discussed above to flatten the frequency response of the buzzer sound system for a hand held computer. Utilizing the pre-filter in the example depicted in FIG. 5, a range of 3 decibels is achieved whereas without using the pre-filter, the buzzer achieves a range of 9 decibels in the usable range from 1 kilohertz to 7 kilohertz.

While the detailed drawings, specific examples and particular formulations given describe exemplary embodiments, they serve the purpose of illustration only. The hardware and software configurations shown and described may differ depending on the chosen performance characteristics and physical characteristics of the computing devices. For example, the type of computing device, communications bus, or processor used may differ. The systems shown and described are not limited to the precise details and conditions disclosed. Furthermore, other substitutions, modifications, changes, and omissions may be made in the design, operating conditions, and arrangement of the exemplary embodiments without departing from the scope of the invention as expressed in the appended claims.

What is claimed is:

1. An apparatus configured to improve sound quality for a sound generator, comprising:

a processing device;

a memory coupled to the processing device;

a sound generator coupled to the processing device; and a program residing in memory and configured to be run on the processing device, the program configured to vary the output amplitude of the sound generator depending on the frequency output of the sound generator.

2. The apparatus of claim 1, wherein the sound generator is a buzzer.

3. The apparatus of claim 1, wherein the program references a look up table including information used to determine the magnitude to vary the output amplitude of the sound generator.

4. The apparatus of claim 1, wherein the sound generator is incorporated into a handheld computing device.

5. The apparatus of claim 1, wherein the sound generator is incorporated into a personal digital assistant.

6. The apparatus of claim 1, wherein the program is configured to provide a flattened frequency response of the sound generator.

7. The apparatus of claim 1, wherein the sound generator is incorporated into a mobile electronic device.

8. A sound generator circuit, comprising:

a processor, a memory coupled to the processor, a modulator circuit coupled to the processor;

a transistor coupled the modulator circuit;

a sound generator coupled to the transistor; and a program residing in memory and configured to be run on the processor, the program configured to vary the output amplitude of the sound generator depending on the output frequency of the sound generator.

9. The sound generator circuit of claim 8, wherein the transistor is a darlington transistor.

10. The sound generator circuit of claim 8, wherein the sound generator circuit is configured to be used in a personal digital assistant.

11. The sound generator circuit of claim 8, wherein the sound generator circuit is configured to be used with a mobile electronic device.

12. The sound generator circuit of claim 8, wherein the sound generator is a buzzer.

13. The sound generator circuit of claim 8, wherein the sound generator is a Bujeon sound generator.

14. The sound generator circuit of claim 8, wherein the sound generator is a Citizen sound generator.

15. A method of improving sound quality for a sound generator, comprising:

providing a signal indicative of a sound frequency to be generated;

accessing a look up table according to the sound frequency to be generated to obtain volume adjustment information;

providing the current volume setting; and adjusting the volume based on the volume adjustment information.

16. The method of claim 15, further comprising:

scaling the volume adjustment information based on the current volume setting to obtain a scaled volume adjustment.

17. The method of claim 16, further comprising:

subtracting the scaled volume adjustment from the current volume setting to obtain a desired volume setting.

18. The method of claim 17 Further comprising:

setting the volume to the desired volume setting.

19. The method of claim 18 further comprising generating a sound at the sound frequency to be generated.

20. A method of improving sound quality for a sound generator, comprising:

providing a signal indicative of a sound frequency to be generated;

calculating volume adjustment information according to the sound frequency to be generated;

providing the current volume setting; and adjusting the volume based on the volume adjustment information.

* * * * *